US010138774B2

(12) United States Patent
Diehl et al.

(10) Patent No.: US 10,138,774 B2
(45) Date of Patent: Nov. 27, 2018

(54) SILENCER FOR AN INTERNAL COMBUSTION ENGINE OF A MOTOR VEHICLE

(71) Applicant: GM GLOBAL TECHNOLOGY OPERATIONS LLC, Detroit, MI (US)

(72) Inventors: Christoph Diehl, Mainz (DE); Kai Becker, Oftersheim (DE); Artem Seryi, Wiesbaden (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 34 days.

(21) Appl. No.: 14/957,685

(22) Filed: Dec. 3, 2015

(65) Prior Publication Data

US 2016/0160717 A1 Jun. 9, 2016

(30) Foreign Application Priority Data

Dec. 3, 2014 (DE) ..... 20 2014 009 602 U

(51) Int. Cl.
*F01N 1/02* (2006.01)
*F02B 33/44* (2006.01)
*F02M 35/12* (2006.01)

(52) U.S. Cl.
CPC ..... *F01N 1/02* (2013.01); *F02B 33/44* (2013.01); *F02M 35/1261* (2013.01); *F02M 35/1266* (2013.01); *F01N 2490/02* (2013.01); *F01N 2590/00* (2013.01)

(58) Field of Classification Search
CPC .... F01N 1/02; F01N 2490/02; F01N 2590/00; F02B 33/44; F02M 35/1261; F02M 35/1266
See application file for complete search history.

(56) References Cited

U.S. PATENT DOCUMENTS 4,244,442 A 1/1981 Scarton et al.
5,792,247 A 8/1998 Gillingham et al.
6,983,820 B2 * 1/2006 Boast ..... F01N 1/003 181/232
7,958,728 B2 6/2011 Dumas et al.
(Continued)

FOREIGN PATENT DOCUMENTS

DE 102004049446 A1 4/2006
DE 102007042869 A1 3/2009
(Continued)

OTHER PUBLICATIONS

German Patent Office, German Search Report for German Application No. 202014009602.3, dated Sep. 9, 2015.

*Primary Examiner* — Brandon Lee
(74) *Attorney, Agent, or Firm* — Lorenz & Kopf, LLP

(57) ABSTRACT

A silencer for an internal combustion engine of a motor vehicle having a turbocharger and a charge air cooler is provided. The silencer includes a turbocharger module with a passage duct. An inlet interface is fastened to an outlet connector of the turbocharger of the internal combustion engine. An outlet interface of the turbocharger module is fastened one or more modules configured as a resonator module and/or a charge air cooler module. An outlet interface of the module most remote from the outlet connector of the turbocharger is fastened to an inlet interface of a feed line for the charge air cooler of the internal combustion engine.

9 Claims, 2 Drawing Sheets

(56) References Cited

U.S. PATENT DOCUMENTS

| | | | | |
|---|---|---|---|---|
| 2002/0043235 | A1 | 4/2002 | Stuart | |
| 2003/0085071 | A1 | 5/2003 | Boast et al. | |
| 2005/0284692 | A1 | 12/2005 | McWilliam et al. | |
| 2016/0201621 | A1* | 7/2016 | Grieswald | F16L 55/033 181/229 |

FOREIGN PATENT DOCUMENTS

| | | | | |
|---|---|---|---|---|
| DE | 102008007961 | B3 | 7/2009 | |
| DE | 102008015353 | A1 | 9/2009 | |
| DE | 102009032377 | A1 | 2/2010 | |
| DE | 102010020064 | A1 | 11/2011 | |
| DE | 202013103960 | U1 * | 10/2013 | F16L 55/033 |
| EP | 1956281 | A1 | 8/2008 | |
| GB | 2389150 | A | 12/2003 | |
| WO | 9827321 | A1 | 6/1998 | |
| WO | 2015092488 | A1 | 6/2015 | |

* cited by examiner

SILENCER FOR AN INTERNAL COMBUSTION ENGINE OF A MOTOR VEHICLE

CROSS-REFERENCE TO RELATED APPLICATION

This application claims priority to German Patent Application No. 202014009602.3, filed Dec. 3, 2014, which is incorporated herein by reference in its entirety.

TECHNICAL FIELD

The present disclosure pertains to a silencer for an internal combustion engine of a motor vehicle, to a silencer kit for the optional production of different silencers and to a motor vehicle, in particular to a passenger car having such a silencer.

BACKGROUND

From DE 10 2010 020 064 A1 a silencer arrangement for a supercharged motor vehicle internal combustion engine is known. A first housing part is connected to a connector of a turbocharger. A second housing part is connected to a feed line of a charge air cooler and the first housing part. The first and second housing parts together with an orifice form two resonator chambers.

For different turbocharging connectors, charge air cooler feed lines and/or resonator chamber pairs a large variant variety has to be disadvantageously made available.

SUMMARY

In accordance with the present disclosure the production and/or functionality of a silencer for an internal combustion engine of a motor vehicle is improved. According to an aspect of the present disclosure, a silencer for an internal combustion engine of a motor vehicle having a turbocharger and a charge air cooler is provided. The silencer includes a turbocharger module with a passage duct, an inlet interface which can be fastened to an outlet connector of the turbocharger of the internal combustion engine, and an outlet interface as well as at least one resonator model with a passage duct, at least one independent resonator chamber, which via at least one choke communicates with the passage duct, an inlet interface which can be fastened to the outlet interface of the turbocharger module, and an outlet interface.

An independent resonator chamber in an embodiment is formed by the resonator module alone, in particular independently of a further module connected therewith, in particular resonator and turbocharger module. Because of this, the functions of the fastening to the outlet connector and the silencing through resonator chambers can be advantageously distributed over different modules in an embodiment. Accordingly, in an embodiment, the same resonator module can be advantageously connected with different turbocharger modules to different outlet connectors. Equally, in an embodiment, the same turbocharger module can be advantageously equipped with different resonator modules in order to optionally realize different silencing characteristics.

In an embodiment, the silencer includes at least one further resonator module which includes a passage duct, at least one independent resonator chamber, which via at least one choke communicates with the passage duct, an inlet interface which can be fastened, in particular is or will be fastened detachably or permanently to the outlet interface of an adjacent resonator module nearer the turbocharger, and an outlet interface. Because of this, in an embodiment, different resonator modules with different resonator chambers can be or are connected in series and thus different frequency ranges can be or are thus dampened in particular advantageously.

In an embodiment, the silencer includes a resonator chamberless charge air cooler module which includes a passage duct, an inlet interface which is fastenable, is fastened or being fastened in particular detachably or permanently on the outlet interface of an adjacent resonator module nearer the turbocharger, and an outlet interface which is fastenable, in particular is fastened or being fastened detachably or permanently to a feed line of a charge air cooler of the internal combustion engine. Because of this, in an embodiment, the functions of the fastening on the teed line and of the silencing through resonator chambers can be advantageously distributed over different modules. Accordingly, in an embodiment, the same resonator module can be advantageously connected with different charge air cooler modules to different feed lines. Equally, in an embodiment, the same charge air cooler module can be advantageously equipped with different resonator modules in order to optionally realize different silencing characteristics.

In an embodiment, the outlet interface of one of the resonator modules (furthest away from the turbocharger module) is fastenable, in particular is fastened on a feed line of a charge air cooler of the internal combustion engine or this outlet interface is being fastened to the feed line. Because of this, a separate charge air cooler module can be saved in an embodiment.

An interface, in particular an inlet or outlet interface, is or will be fastenable, in particular is detachably fastened to a mating interface in an embodiment, in particular an outlet or inlet interface, the outlet connector or the feed line Because of this, in an embodiment, a module or the silencer can be advantageously removed again.

In a further development, this interface is a positively lockable, in particular locked plug connection interface, which includes a plug-in connector for inserting into a receptacle of the mating interface or a receptacle for inserting a plug-in connector of the mating interface. In a further development the plug-in connector includes an annular groove in which a fastener, in particular a spring fastener, of the receptacle positively engages to positively lock the plug-in connector in the receptacle. In particular, the plug connection interface can be a so-called an interface meeting the VDA plug connection standards.

Additionally or alternatively, a releasable plug connection between two plug connection interfaces, in particular an outlet interface of a charge air cooler module or resonator module furthest away from the turbocharger module with the feed line can be or will be frictionally locked, in particular by a clip, which presses the feed line onto a plug-in connector of the outlet interface inserted in the feed line.

An interface, in particular an inlet or outlet interface, via which a module will be or is connected to a further module, is fastenable, or will be fastenable, in particular fastened, in particular in a materially joined manner, in particular by gluing or welding, in particular friction welding, permanently, in an embodiment, to a mating interface, in particular to an outlet or inlet interface. Because of this, in an embodiment, two or more modules can be reliably and/or compactly connected to one another with little structural effort.

In an embodiment, at least two of the outlet interfaces, in particular the outlet interfaces of one or more different turbocharger modules and/or the outlet interfaces of one or more different resonator modules are formed for the optional fastening to the same mating interface, in particular inlet interface of a resonator module. Additionally or alternatively, in an embodiment, at least two of the inlet interfaces, in particular the inlet interfaces of one or more different charge air cooler modules and/or the inlet interfaces of one or more different resonator modules are formed for the optional fastening to the same mating interface, in particular outlet interface of a turbocharger or resonator module. Because of this, in an embodiment, optional modules with such inlet or outlet interfaces can be advantageously replaced with one another. In particular, in an embodiment, the same resonator module can be advantageously connected to different turbocharger, resonator and/or charge air cooler modules. Equally, in an embodiment, the same turbocharger or charge air cooler module can be advantageously equipped with different resonator modules.

In an embodiment, one or more of the modules include metal, in particular stainless steel, and/or plastic, in particular they can be or are made from this or consist of this. In an embodiment, one or more of the modules are unitary. Equally, in an embodiment, one or more of the modules can include multiple parts, which are or will be connected to one another in particular permanently, in particular in a materially joined manner.

In an embodiment, one or more of the resonator modules each include exactly one resonator chamber. Because of this, in an embodiment, separate resonator modules can be specifically selected or provided for frequency ranges to be dampened. Equally, in an embodiment, one or more of the resonator modules can each include two or more resonator chambers. Because of this, in an embodiment, different frequency ranges can be dampened by one resonator module and/or length and/or weight of the silencer reduced.

In an embodiment, one of the resonator chambers is or will be designed for a first frequency range. Additionally or alternatively, a further resonator chamber in an embodiment is or will be designed for a second frequency range that is distinct from the first frequency range. A resonator chamber designed for a frequency range dampens in an embodiment frequencies in this frequency range over-proportionally or more than in other frequency ranges.

According to an aspect of the present disclosure, a silencer kit includes a first turbocharger module described here, a first resonator module described here and at least one second turbocharger module described here. The kit further includes an inlet interface that is distinct from the inlet interface of the first turbocharger module, and/or at least one second resonator module described here, which includes an outlet interface that is distinct from the outlet interface of the first resonator module and/or at least one resonator chamber that is distinct from a resonator chamber of the first resonator module. The kit also includes at least one first charge air cooler module described here having an outlet interface that is distinct from the outlet interface of one of the resonator modules or of a second charge air cooler module described here.

Through optional connecting of different ones of the turbocharger modules to the same or different resonator modules or optional connecting of one of the turbocharger modules to different resonator modules, and/or optional connecting of these different assemblies of a turbocharger module and a resonator module to one or multiple further, in particular different resonator modules and/or the same or different charge air cooler modules, different ones of the silencers described here can be or are optionally produced according to an aspect of the present disclosure.

Accordingly, a silencer kit according to an aspect of the present disclosure includes different ones of the silencers described here, wherein the turbocharger, resonator and if appropriate charge air cooler modules of these are in particular detachably or permanently connectable to one another or their interfaces are fastenable to one another, in particular are connected to one another or their interfaces are fastened or will be fastened to one another.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
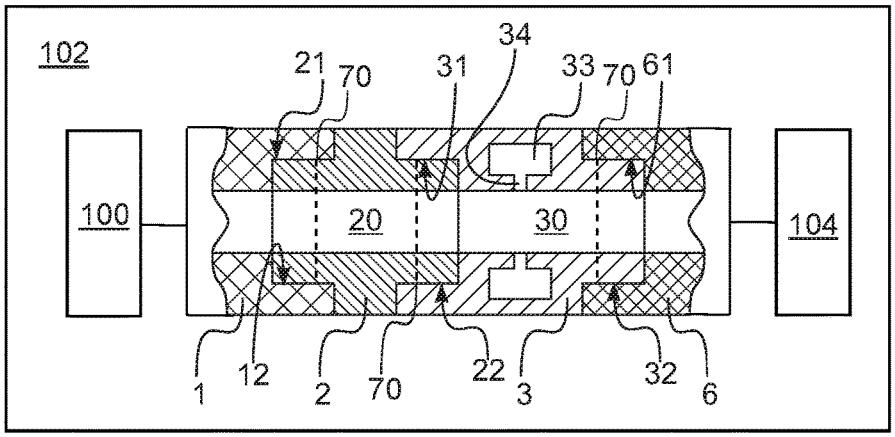
FIG. 1 illustrates a motor vehicle silencer of a silencer kit according to an embodiment of the present disclosure in a longitudinal section.

FIG. 1 shows a motor vehicle silencer of a silencer module according to an embodiment of the present disclosure in a longitudinal section. The silencer module includes a turbocharger module 2 having a passage duct 20, an inlet interface 21, which is or will be detachably fastened to an outlet interface 12 of a connector 1 of a turbocharger 100 for an internal combustion engine 102 of the motor vehicle (not shown). The turbocharger module 2 includes an outlet interface 22, which is or will be detachably fastened to a resonator module 3. The resonator module 3 has a passage duct 30 and an independent resonator chamber 33, which communicates via multiple chokes 34 with the passage duct 30. In the exemplary embodiment of FIG. 1, resonator module 3 is the only resonator module in the silencer module, thus most distant from the turbocharger module 2, and is or will be detachably fastened to an inlet interface 61 of a feed line 6 of a charge air cooler 104 of the internal combustion engine 102.

Figure 2:
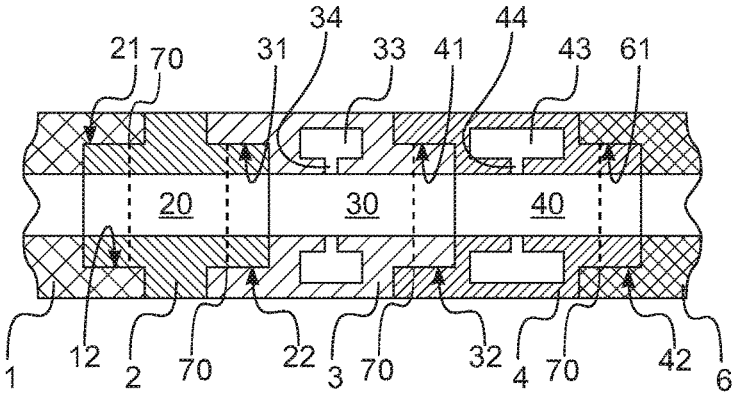
FIG. 2 illustrates a motor vehicle silencer of the silencer kit that is distinct from that shown in FIG. 1 according to an embodiment of the present disclosure in a longitudinal section.

FIG. 2 shows in a manner similar to FIG. 1 a motor vehicle silencer of the silencer kit according to an embodiment of the present disclosure. Corresponding features for the silencer kit shown in FIG. 2 are identified by identical reference characters to that shown in FIG. 1 so that reference is made to the preceding description and only the differences are discussed in the following. In the exemplary embodiment of FIG. 2, the silencer includes an additional resonator module 4, which includes a passage duct 40 and an independent resonator chamber 43, which via multiple chokes 44 communicates with the passage duct 40. An inlet interface 41, which is or will be detachably or permanently fastened to the outlet interface 32 of the adjacent resonator module 3 nearer the turbocharger, and an outlet interface 42. This outlet interface 42 of the resonator module 4, which in the exemplary embodiment of FIG. 2 is most distant from the turbocharger module is or will be detachably fastened to the inlet interface 61 of the feed line 6 instead of the outlet interface 32 of the resonator module 3 as shown in FIG. 1.

Figure 3:
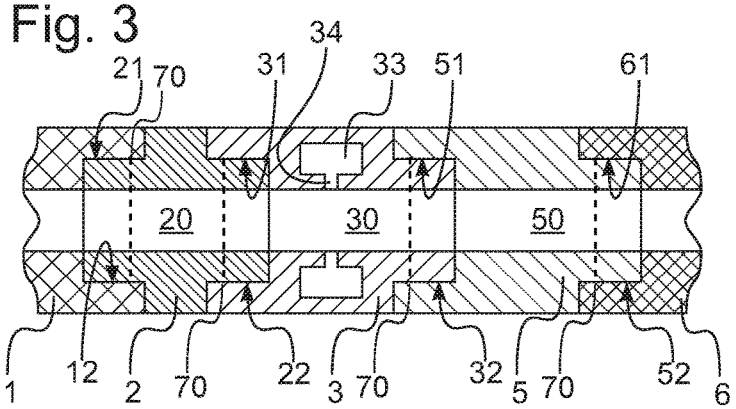
FIG. 3 illustrates a motor vehicle silencer of the silencer kit that is distinct from that shown in FIGS. 1 and 2 according to an embodiment of the present disclosure in a longitudinal section.

FIG. 3 shows in a manner corresponding to FIGS. 1 and 2 a motor vehicle silencer of the silencer kit according to an embodiment of the present disclosure. Corresponding features for the silencer kit shown in FIG. 3 are identified by identical reference characters to that shown in FIGS. 1-2 so that reference is made to the preceding description and only the differences are discussed in the following. In the exemplary embodiment of FIG. 3, the silencer includes a resonator chamberless charge air cooler module 5 in place of the resonator module 4. The module 5 includes a passage duct 50, an inlet interface 51, which instead of the inlet interface 61 of the feed line 6 (see FIG. 1) or instead of the inlet interface 41 of the resonator module 4 (see FIG. 2) is or will be detachably or permanently fastened to the outlet interface of the adjacent resonator module 3 nearer the turbocharger module. An outlet interface 52 of the charge air cooler module 5 is or will be detachably fastened to the inlet interface 61 of the feed line instead of the outlet interface 32 of the resonator module 3 (see FIG. 1) or the outlet interface 42 of the resonator module 4 (see FIG. 2).

Figure 4:
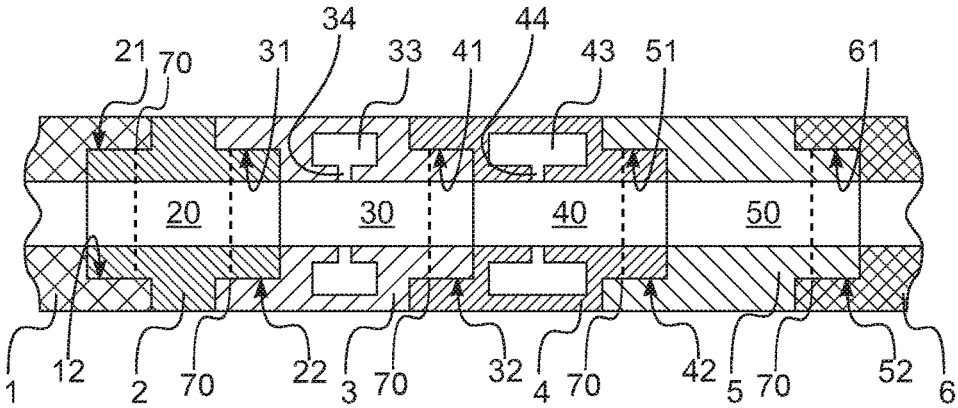
FIG. 4 illustrates a motor vehicle silencer of the silencer kit that is distinct from that shown in FIGS. 1-3 according to an embodiment of the present disclosure in a longitudinal section.

FIG. 4 shows in a manner corresponding to FIGS. 1-3 a motor vehicle silencer of the silence kit according to an embodiment of the present disclosure. Corresponding features for the silencer kit shown in FIG. 4 are identified by identical reference characters to that shown in FIGS. 1-3 so that reference is made to the preceding description and only the differences are discussed in the following. The embodiment of FIG. 4 corresponds to a combination of the embodiments shown FIGS. 2 and 3. Accordingly, the motor vehicle silencer of the exemplary embodiment of FIG. 4 includes both the resonator module 4 fastened to the resonator module 3 and also the charge air cooler module 5, which instead of the resonator module 3 (see FIG. 3) is fastened in the embodiment of FIG. 4 to the resonator module 4.

Figure 5:
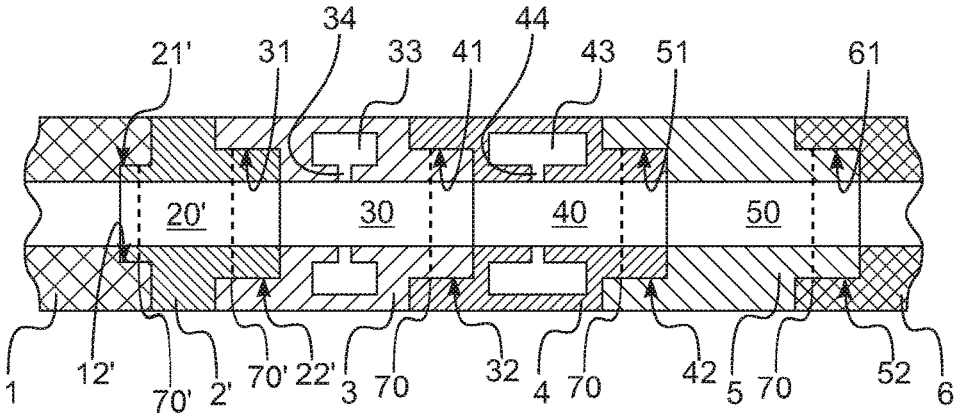
FIG. 5 illustrates a motor vehicle silencer of the silencer kit that is distinct from the previous figures according to an embodiment of the present disclosure in a longitudinal section.

FIG. 5 shows in a manner corresponding to FIGS. 1-4 a motor vehicle silencer of the silencer kit according to an embodiment of the present disclosure. Corresponding features for the silencer kit shown in FIG. 5 are identified by identical reference characters to that shown in FIGS. 1-4 so that reference is made to the preceding description and only the differences are discussed in the following. The embodiment of FIG. 5 corresponds to the exemplary embodiment of FIG. 4, wherein however the outlet connector 1' of the turbocharger has another interface 12'. For this reason, the silencer of the exemplary embodiment of FIG. 5, which is otherwise identical in construction to the exemplary embodiment of FIG. 4, includes a turbocharger module 2' with another inlet interface 21', which is distinct from the turbocharger module 2 or the inlet interface 21 of the exemplary embodiment of FIG. 4.

Interfaces 12-61 are indicated in FIGS. 1-5 schematically. It will, however, be appreciated that each interface may provide a plug-in connector (e.g., 21, 21' 22, 32, 42, 52) for insertion into a receptacle (e.g., 12, 12' 31, 41, 51, 61) of the mating interface. The plug-in connector includes an annular groove, in which a fastener 70, 70', in particular a spring fastener, of the receptacle positively engages thus positively locking the plug-in connector in the receptacle. Additionally or alternatively, a releasable plug connection, in particular of the outlet interface 52 of the charge air cooler module 5 or of the outlet interface 32, 42 of the module most distant from the turbocharger can be or is frictionally locked to the feed line 6, in particular by a clip, which presses the feed line onto a plug-in connector of the outlet interface (not shown) which is inserted in the feed line.

An inlet or outlet interface, via which one of the modules 2-5 is or will be connected to a further one of the modules 2-5, can be or will be permanently fastened to an outlet or inlet interface, in particular in a materially joined manner, in particular by gluing or welding, in particular friction welding. The outlet interfaces 22, 22' of the turbocharger modules 2, 2' of the exemplary embodiments of FIGS. 1-5 are designed for the optional fastening to the same mating interface 31. The outlet interfaces 32, 42 and 52 respectively of one or multiple of the resonator modules 3, 4 and/or of the charge air cooler module 5 can also be designed for the optional fastening to the same mating interface 41, 51 respectively 61. Additionally or alternatively, in an embodiment, at least two of the inlet interfaces 31, 41 and/or 51 can be designed for the optional fastening to the same mating interface 32, 42 respectively 52.

In the exemplary embodiments, the resonator modules 3, 4 each include exactly one resonator chamber 33 and 43 respectively. Here, the resonator Chamber 33 is designed for a first frequency range, the further resonator chamber 43 for a second frequency range that is distinct from the first frequency range.

Viewing FIGS. 1-5 together illustrates a silencer kit according to an aspect of the present disclosure. As is evident by comparing the various embodiments, optionally different silencers can be or are optionally modularly produced by optionally connecting different ones of the turbocharger modules (see FIGS. 4, 5) to the same (or different) resonator modules (or optional connecting of one of the turbocharger modules to different resonator modules) and/or optional connecting of these different assemblies of a turbocharger and a resonator module 2, 3 to a further, in particular different resonator module 4 (see FIGS. 1, 2) and/or the same (or different) charge air cooler modules 5 (see FIGS. 2, 3, 4).

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A silencer for an internal combustion engine of a motor vehicle having a turbocharger having a turbocharger connector and a charge air cooler having a feed line, the silencer comprising:

a turbocharger module having a first inlet interface configured to be fastened to the turbocharger connector, a first outlet interface and a first passage duct extending through the turbocharger module; and a resonator module having a second inlet interface detachably fastened with a fastener to the first outlet interface of the turbocharger module forming a plug connection interface, a second outlet interface configured to be fastened to the feed line, a second passage duct extending through the resonator module and in communication with the first passage duct, and a resonator chamber in communication with the second passage duct via a choke formed in the resonator module.

2. The silencer according to claim 1, wherein the resonator module comprises:

a first resonator element adjacent the second inlet interface having a first resonator chamber in communication with the second passage duct via a first choke formed in the first resonator element, and a second resonator element adjacent the second outlet interface having a second resonator chamber in communication with the second passage duct via a second choke formed in the second resonator element, wherein the first resonator element and the second resonator element are arranged in series between the turbocharger connector and the feed line.

3. The silencer according to claim 2, wherein the first resonator chambers is designed for a first frequency range and the second resonator chamber is designed for a second frequency range which is distinct from the first frequency range.

4. The silencer according to claim 2, wherein an outlet interface on each of the first and second resonator elements are configured to provide a common mating interface with the inlet interfaces of the first and second resonator elements such that the order of the first and second resonator elements are interchangeable.

5. The silencer according to claim 1, wherein the resonator module comprises a first resonator element adjacent the turbocharger module having a first resonator chamber in communication with the second passage duct via a first choke formed in the first resonator element and a second chamberless charge air cooler element adjacent the second outlet interface.

6. The silencer according to claim 5, wherein an outlet interface on each of the first resonator element and the second chamberless charge air cooler element are configured to provide a common mating interface with the inlet interfaces of the first resonator element and the second chamberless charge air cooler element such that the order of the first resonator element and the second chamberless charge air cooler are interchangeable.

7. The silencer according to claim 1 wherein the plug connection interface comprises a positively lockable connection.

8. The silencer according to claim 7 wherein the positively lockable connection comprises a locked plug connection interface.

9. A silencer kit used when assembling a silencer for an internal combustion engine of a motor vehicle having a turbocharger with a turbocharger connector and a charge air cooler having a feed line, the silencer kit comprising:

a first turbocharger module having a first turbocharger inlet interface, a first turbocharger outlet interface and a first turbocharger passage duct extending through the first turbocharger module;

a second turbocharger module having a second turbocharger inlet interface that is distinct from the first turbocharger inlet interface, a second turbocharger outlet interface and a second turbocharger passage duct extending through the second turbocharger module;

a first resonator module having a first resonator inlet interface configured to be detachably fastened with a first fastener to the turbocharger outlet interface of either the first or second turbocharger module forming a first plug connection interface, a first resonator outlet interface, a first resonator passage duct extending through the first resonator module and in communication with the passage duct of either the first or second turbocharger module, and a first resonator chamber in communication with the first passage duct via a first choke formed in the first resonator module;

a second resonator module having a second resonator inlet interface configured to be detachably fastened with a second fastener to the turbocharger outlet interface of either the first or second turbocharger module forming a second plug connection interface, a second resonator outlet interface, a second resonator passage duct extending through the second resonator module and in communication with the passage duct of either the first or second turbocharger module, and a second resonator chamber in communication with the second passage duct via a second choke formed in the second resonator module; and a chamberless module having an inlet interface configured to be detachably fastened with a third fastener to the outlet interface of either the first or second turbocharger module or the first or second resonator module forming a third plug connection interface and an outlet interface;

wherein the silencer is assembled from a first module selected from the group consisting of the first turbocharger module and the second turbocharger module arranged in series with a second module selected from the group consisting of the first resonator module, the second resonator module, the chamberless module and combinations thereof for locating between the turbocharger connector and the charge air cooler connector.

* * * * *